US012279657B2

(12) United States Patent
Hudy

(10) Patent No.: US 12,279,657 B2
(45) Date of Patent: Apr. 22, 2025

(54) GARMENTS WITH INTEGRATED BRA FEATURE

(71) Applicant: Pearl Pajamas, LLC, Phoenixville, PA (US)

(72) Inventor: Michelle Hudy, Phoenixville, PA (US)

(73) Assignee: Pearl Pajamas, LLC, Phoenixville, PA (US)

( * ) Notice: Subject to any disclaimer, the term of this patent is extended or adjusted under 35 U.S.C. 154(b) by 392 days.

(21) Appl. No.: 17/930,581

(22) Filed: Sep. 8, 2022

(65) Prior Publication Data

US 2024/0081432 A1 Mar. 14, 2024

(51) Int. Cl.
*A41C 3/08* (2006.01)
*A41B 1/08* (2006.01)

(52) U.S. Cl.
CPC . *A41C 3/08* (2013.01); *A41B 1/08* (2013.01)

(58) Field of Classification Search
CPC ..... A41C 3/08; A41B 1/08
USPC ..... 450/30–33
See application file for complete search history.

(56) References Cited

U.S. PATENT DOCUMENTS 1,254,043 A * 1/1918 James ..... A41C 3/08 450/31
3,098,485 A 7/1963 Dixie
7,186,163 B2 * 3/2007 Carlucci ..... A41D 1/18 450/33
7,628,675 B2 12/2009 Staub
8,403,724 B1 * 3/2013 Chapin ..... A41C 3/08 450/32
8,545,287 B2 * 10/2013 Campbell ..... A41C 3/0021 450/67
9,578,901 B2 * 2/2017 Randall ..... A41C 3/02
10,390,571 B2 * 8/2019 McKeen ..... A41C 3/128
10,595,569 B2 * 3/2020 Oguchi ..... A41C 3/144
10,743,591 B1 * 8/2020 Cavosie ..... A41C 3/08
10,881,154 B2 5/2021 Cavosie
12,029,261 B1 * 7/2024 Englebrecht ..... A41C 3/0064
2006/0223414 A1 * 10/2006 Staub ..... A41C 3/0057 450/1
2007/0004314 A1 * 1/2007 Carlucci ..... A41D 27/00 450/30

(Continued)

FOREIGN PATENT DOCUMENTS

CN 201774988 U 3/2011
CN 206472866 U 8/2017

(Continued)

*Primary Examiner* — Gloria M Hale
(74) *Attorney, Agent, or Firm* — Dinsmore & Shohl LLP

(57) ABSTRACT

A garment to be worn by a wearer includes an outer body that defines a garment shoulder and an underarm portion disposed below the garment shoulder of the garment. The garment includes a bra feature coupled to the underarm portion. The bra feature includes a bra body and a first attachment member. The bra body is configured to encircle a chest of the wearer. The first attachment member extends between a first end and a second end. The first attachment member is coupled to the bra body at the first end and to the underarm portion of the garment at the second end, thereby fixing the bra body to the underarm portion of the garment while permitting movement of the bra body relative to the underarm portion of the garment.

20 Claims, 3 Drawing Sheets

(56) References Cited

U.S. PATENT DOCUMENTS

| | | | | |
|---|---|---|---|---|
| 2011/0244757 | A1* | 10/2011 | Mays | A41C 3/0021 450/86 |
| 2016/0219951 | A1 | 4/2016 | Shickel | |

FOREIGN PATENT DOCUMENTS

| | | | |
|---|---|---|---|
| GB | 2475697 | A | 6/2011 |
| KR | 20210145525 | A | 2/2021 |

* cited by examiner

GARMENTS WITH INTEGRATED BRA FEATURE

TECHNICAL FIELD

The present specification generally relates to clothing, and more specifically, to supportive garments.

BACKGROUND

Some garments have integrated, or built-in, bra features such that a wearer's chest may be supported without having to don a bra separately. However, such integration often causes the bra feature to move with the garment, which may result in discomfort of the wearer.

SUMMARY

In a first aspect A1, a garment includes an outer body and a bra feature. The outer body defines a garment shoulder and an underarm portion disposed below the garment shoulder. The bra feature includes a bra body configured to encircle a chest of a wearer and a first attachment member having a first end coupled to the bra body and a second end spaced a length from the first end. The second end is coupled to the underarm portion of the garment, thereby fixing the bra body to the underarm portion of the garment while permitting movement of the bra body relative to the underarm portion of the garment.

In a second aspect A2, according to the first aspect A1, the bra feature further comprises a shoulder strap.

In a third aspect A3 according to the second aspect A2, the shoulder strap comprises a slider movable to selectively adjust a length of the shoulder strap.

In a fourth aspect A4 according to the second aspect A2 or the third aspect A3, the shoulder strap has a thickness of greater than 0.5 inches.

In a fifth aspect A5 according to any of the second through fourth aspects A2-A4, the garment shoulder further comprises a retention loop fixed to the garment shoulder, the retention loop configured to retain the shoulder strap to the garment shoulder.

In a sixth aspect A6 according to the fifth aspect A5, the retention loop comprises a closure configured to open and close the retention loop, wherein the shoulder strap is detachable from the garment shoulder when the retention loop is open.

In a seventh aspect A7, according to any preceding aspect, the bra feature further includes a second attachment member extending between the bra body and a second underarm portion; the first attachment member is disposed beneath a right arm of the wearer; and the second attachment member is disposed beneath a left arm of the wearer.

In an eighth aspect A8 according to any preceding aspect, the length of the first attachment member is greater than 0.5 inches.

In a ninth aspect A9 according to any preceding aspect, the bra feature further comprises cups coupled to the bra body and configured to support breasts of the wearer.

In a tenth aspect A10 according to the ninth aspect A9, the cups are removably coupled to the bra body.

In an eleventh aspect A11 according to any preceding aspect, the bra feature further comprises an elastic band disposed along a bottom of the bra feature.

In a twelfth aspect A12, a garment, includes an outer body and a bra feature. The outer body defines a garment shoulder and an underarm portion disposed below the garment shoulder. The bra feature includes a bra body configured to encircle a chest of a wearer and a first attachment member having a first end coupled to the bra body and a second end spaced a length from the first end. The second end is coupled to the underarm portion of the garment, thereby fixing the bra body to the underarm portion of the garment while permitting movement of the bra body relative to the underarm portion of the garment. The bra feature includes a first shoulder strap extending from the bra body and configured to extend over a shoulder of the wearer, wherein the first shoulder strap is coupled to the garment shoulder.

In a thirteenth aspect A13 according to the twelfth aspect A12, the first shoulder strap is coupled directly to the garment shoulder.

In a fourteenth aspect A14 according to the twelfth aspect A12 or the thirteenth aspect A13, the first shoulder strap is coupled to the garment shoulder via a retention loop extending from the garment shoulder.

In a fifteenth aspect A15 according to any of the twelfth though fourteenth aspects A12-A14, the bra feature further includes a second shoulder strap, wherein the first shoulder strap and the second shoulder strap are arranged in a racerback configuration.

In a sixteenth aspect A16 according to any of the twelfth though fifteenth aspects A12-A15, the first shoulder strap has an adjustable length.

In a seventeenth aspect, a garment to be worn by a wearer includes a shirt and a bra feature. The shirt includes a garment shoulder and an underarm portion disposed below the garment shoulder. The bra feature includes a bra body configured to encircle a chest of a wearer and a first attachment member having a first end coupled to the bra body and a second end spaced a length from the first end. The second end is coupled to the underarm portion of the shirt, thereby fixing the bra body to the underarm portion of the shirt while permitting movement of the bra body relative to the underarm portion of the shirt.

In an eighteenth aspect A18 according to the seventeenth aspect A17, the first attachment member extends between the first end and the second end for a length of greater than 1.5 inches.

In a nineteenth aspect A19 according to the seventeenth aspect A17 or the eighteenth aspect A18, the bra feature further comprises a shoulder strap.

In a twentieth aspect A20 according to the nineteenth aspect A19, the shoulder strap comprises a slider configured to selectively adjust a length of the shoulder strap.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

Figure 1:
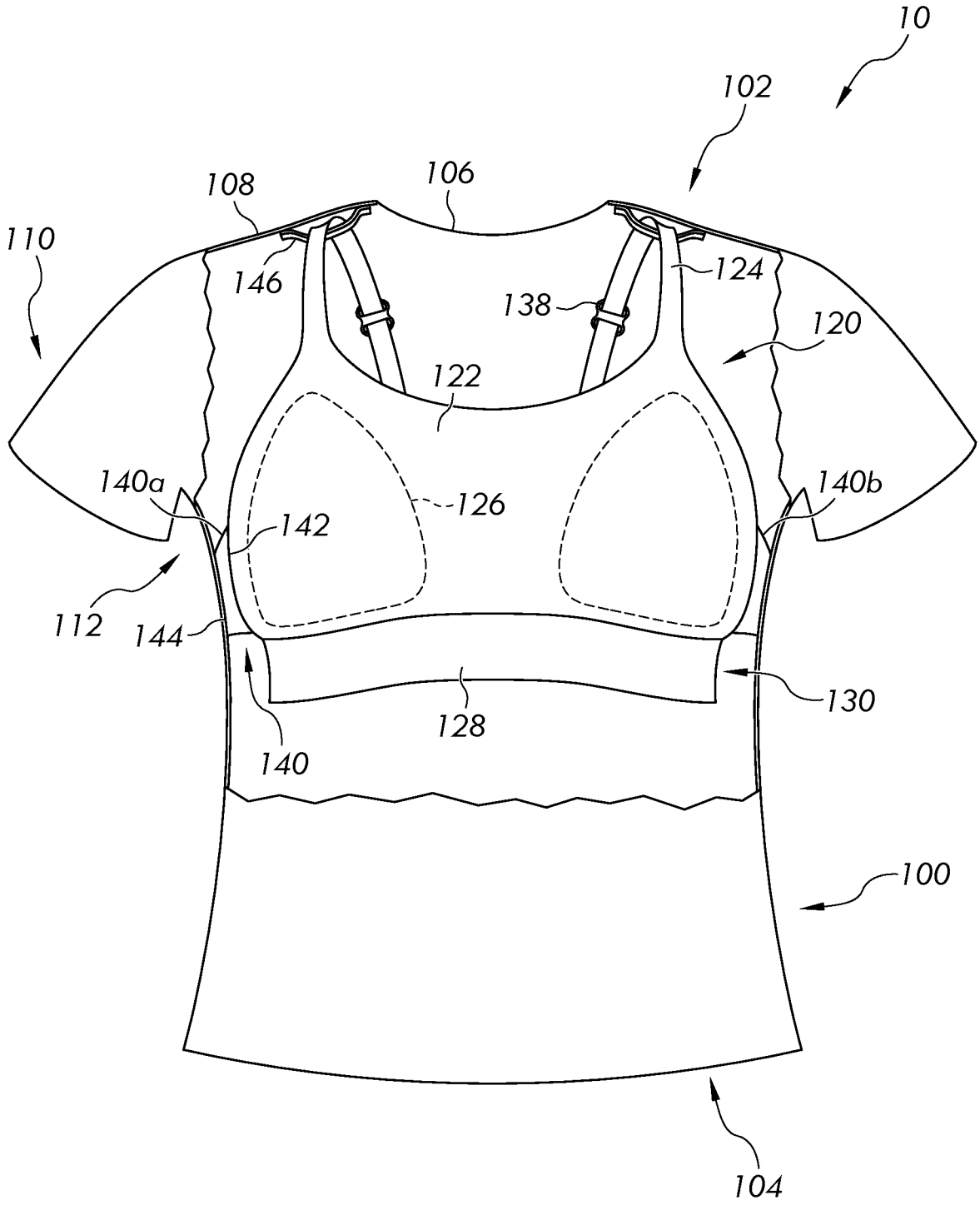
FIG. 1 schematically depicts a garment, according to one or more embodiments shown and described herein.

Additional features and advantages of the present disclosure will be set forth in the detailed description, which follows, and in part will be apparent to those skilled in the art from that description or recognized by practicing the embodiments described herein, including the detailed description, which follows the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments and are incorporated into and constitute a part of this specification. The drawings illustrate the various embodiments described herein, and together with the description, explain the principles and operations of the claimed subject matter.

DETAILED DESCRIPTION

Reference will now be made in detail to various embodiments of devices, assemblies, and methods, examples of which are illustrated in the accompanying drawings. Whenever possible, the same reference numerals will be used throughout the drawings to refer to the same or like parts. The present disclosure generally relates to a garment to be worn by a wearer. The garment may include a garment shoulder, an underarm portion disposed below the garment shoulder of the garment, and a bra feature coupled to the underarm portion. The bra feature may include a bra body and a first attachment member. The bra body may be configured to encircle a chest of the wearer. The first attachment member may extend between a first end and a second end. The first attachment member may be coupled to the bra body at the first end and to the underarm portion of the garment at the second end, thereby fixing the bra body to the underarm portion of the garment while permitting movement of the bra body relative to the underarm portion of the garment. Accordingly, this freedom of movement may provide additional comfort to the wearer without sacrificing the convenience of an integrated bra feature.

Directional terms as used herein—for example up, down, right, left, front, back, top, bottom—are made only with reference to the figures as drawn and are not intended to imply absolute orientation unless otherwise specified.

Unless otherwise expressly stated, it is in no way intended that any method set forth herein be construed as requiring that its steps be performed in a specific order, nor that with any apparatus specific orientations be required. Accordingly, where a method claim does not actually recite an order to be followed by its steps, or that any device or assembly claim does not actually recite an order or orientation to individual components, or it is not otherwise specifically stated in the claims or description that the steps are to be limited to a specific order, or that a specific order or orientation to components of an device or assembly is not recited, it is in no way intended that an order or orientation be inferred, in any respect. This holds for any possible non-express basis for interpretation, including: matters of logic with respect to arrangement of steps, operational flow, order of components, or orientation of components; plain meaning derived from grammatical organization or punctuation; and the number or type of embodiments described in the specification.

As used herein, the singular forms "a," "an," and "the" include plural referents unless the context clearly dictates otherwise. Thus, for example, reference to "a" component includes aspects having two or more such components, unless the context clearly indicates otherwise.

Referring to FIG. 1, a garment 10 is schematically depicted. As depicted, the garment 10 may have an outer body 100. The outer body 100 may be a shirt, such as a t-shirt or tank top. In other embodiments, the outer body 100 may be a dress or other garment. The outer body 100 may extend between a top portion 102 and a bottom portion 104 opposite the top portion 102. The top portion 102 may define an open neck 106 and a shoulder 108. In particular, the top portion 102 may include two shoulders 108, and the two shoulders 108 may be disposed on either side of the open neck 106. Adjacent each shoulder 108 may be an arm portion 110. The arm portion 110 may open to an exterior of the outer body 100 such that a wearer's arm may extend therethrough. The arm portion 110 may be shaped as a sleeve or may be an open aperture such as is commonly found in tank tops. In some embodiments, the arm portion 110 may be omitted. Disposed between the top portion 102 and the bottom portion 104 may be an underarm portion 112. The underarm portion 112 may be disposed lower than the shoulder 108 and the arm portion 110 and may align approximately with the ribcage or chest of a wearer.

The garment 10 may include a bra feature 120 within the outer body 100. The bra feature 120 may include a bra body 122 configured to encircle the chest of a wearer. The bra body 122 may include a clasp (not pictured) for easy donning and removal of the bra feature 120. In other embodiments, the bra body 122 may be continuous, i.e. without a clasp or other feature to open or close the bra body 122. The bra body 122 may be made from elastic or other stretchable material for comfort and for each donning and removal, and/or to ensure a fit that conforms to the wearer's body. The bra body 122 may include cups 126 configured to support the breasts of a wearer. In some embodiments, the cups 126 may be fixed to the bra body 122 such as with stitching, adhesive, or the like. In other embodiments, the cups 126 may be removably coupled to the bra body 122. For example, the cups 126 may be removably disposed within a pocket of the bra body 122. Accordingly, a wearer may customize the amount of support or rigidity of the bra body 122 by including or removing the cups 126. The bra body 122 may include an elastic band 128 disposed along a bottom 130 of the bra body 122 such that the elastic band 128 is snug against the wearer. Accordingly, the elastic band 128 may retain the bra body 122 in place against the wearer while the garment 10 is unrestrained by the elastic band 128. This may prevent the bra body 122 from shifting uncomfortably relative to the wearer. Additionally, the elastic band 128 may support the chest of the wearer without the use boning, underwire, or other inflexible support methods.

Figure 2:
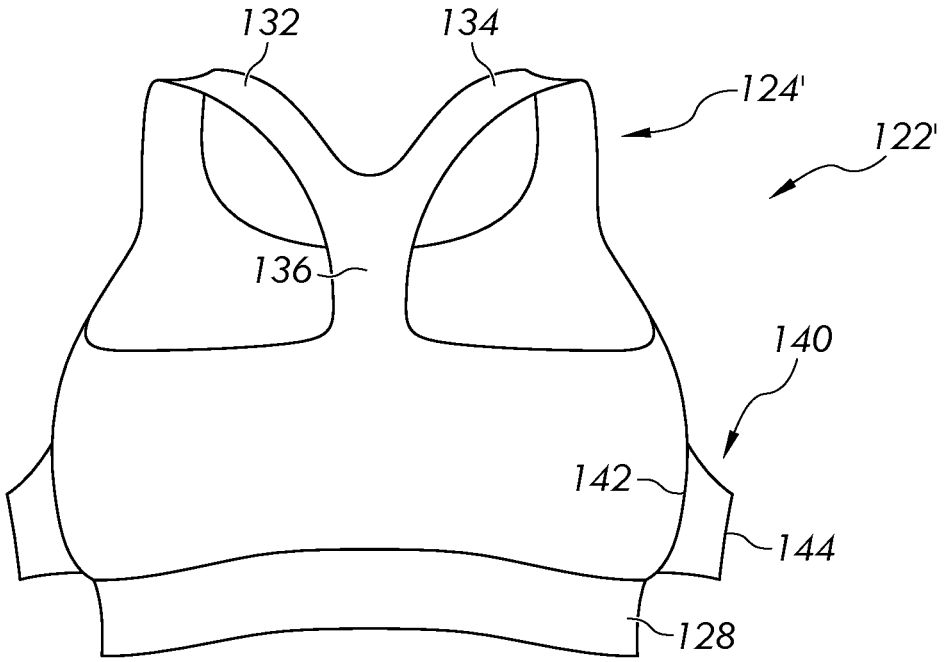
FIG. 2 schematically depicts a bra portion of a garment, according to one or more embodiments shown and described herein.

The bra feature 120 may include shoulder straps 124 extending from the bra body 122 such that the shoulder straps 124 may extend over the shoulders of a wearer. The shoulder straps 124 may be arranged parallel or substantially parallel to each other, in a racerback orientation, in a crossed orientation, or in any other appropriate orientation. A racerback orientation is depicted, for example, in FIG. 2. As shown in FIG. 2, a bra portion 122' includes shoulder straps 124'. The shoulder straps 124' may include a first shoulder strap 132, a second shoulder strap 134, and a center strap 136. The first shoulder strap 132 and the second shoulder strap 134 may be coupled together at the back of the wearer and may combine to form the center strap 136, as depicted. Referring back to FIG. 1, the shoulder straps 124 may have any appropriate thickness, such as about 0.5 inches, about 1 inch, about 1.5 inches, about 2 inches, or any other appropriate thickness. In some embodiments, a greater thickness, e.g. greater than 0.5 inches, may provide additional comfort to the wearer by minimizing pressure along the shoulders of the wearer. The shoulder straps 124 may have an adjustable or nonadjustable length. For example, in some embodiments, the shoulder straps 124 may include sliders 138 in order to provide adjustable length to the shoulder straps 124. The sliders 138 may take up or let out an overlapped length of the shoulder straps 124 such that the shoulder straps 124 have an adjustable length over the shoulders of the wearer. The shoulder straps 124 may be the same material as or a different material than the bra body 122. In some embodiments, the bra feature 120 may not include shoulder straps 124 and may instead have a bandeau or tube shape.

Still referring to FIG. 1, the garment 10 may include one or more attachment members 140, such as first attachment member 140*a* and second attachment member 140*b*. The one or more attachment members 140 may extend between a first end 142 and a second end 144. The one or more attachment members 140 may be coupled to the bra body 122 at the first end 142 and may be coupled to the underarm portion 112 at the second end 144. In particular, one or more attachment members 140 may be coupled to the bra body 122 and the garment 10 such that the one or more attachment members 140 are directly beneath arms of the wearer. For example, the first attachment member 140*a* may be coupled beneath the right arm of the wearer while the second attachment member 140*b* may be coupled beneath the left arm of the wearer. Accordingly, the first attachment member 140*a* and the second attachment member 140*b* may be coupled at opposing ends of the garment 10. The attachment members 140 may extend a length between the first end 142 and the second end 144 such that bra feature 120 may move relative to the outer body 100 and vice versa. More specifically, the attachment members 140 may fix the bra body 122 to the underarm portion 112 of the outer body 100 while permitting some movement of the bra body 122 relative to the underarm portion 112 of the outer body 100. For example, in embodiments wherein the length of the attachment members 140 is about 1 inch, the outer body 100 may rotate about the wearer about 1 inch relative to the bra body 122. This may provide additional comfort to the wearer. Without the freedom of movement provided by length of the one or more attachment features 140, the bra feature 120 may uncomfortably tug against the wearer if the outer body 100 is moved, e.g., from turning over during sleep. Simultaneously, the attachment members 140 may prevent excessive movement of the outer body 100 relative to the bra body 122. For example, in embodiments wherein the length of the attachment members 140 is about 1 inch, the outer body 100 may rotate about the wearer no more than about 1 inch relative to the bra body 122. This may allow the wearer to move, e.g. bend over, etc., without worry of exposing the bra body 122 from beneath the outer body 100. In embodiments, the attachment members 140 may have a length greater than about 0.5 inches, 1 inch, 1.5 inches, 2 inches, or any other appropriate length. The attachment members 140 may be made from fabric, elastic, or any other appropriate material.

Still referring to FIG. 1, the garment 10 may include retention loops 146 coupled to the shoulders 108 of the garment 10. The retention loops 146 may extend across the shoulders 108 of the outer body 100, i.e. from the open neck 106 to the arm portion 110. The retention loops 146 may be large enough such that the shoulder straps 124 may fit between the retention loops 146 and the shoulders 108 of the outer body 100, such as depicted. Accordingly, the retention loops 146 may retain the shoulder straps 124 to the shoulders 108 of the outer body 100. The retention loops 146 may be large enough such that the shoulder straps 124 may shift slightly relative to the shoulders 108 of the outer body 100 while still being generally retained by the retention loops 146. This may provide some additional freedom of movement of the bra feature 120 relative to the outer body 100 and, accordingly, may provide additional comfort to a wearer.

Figure 3:
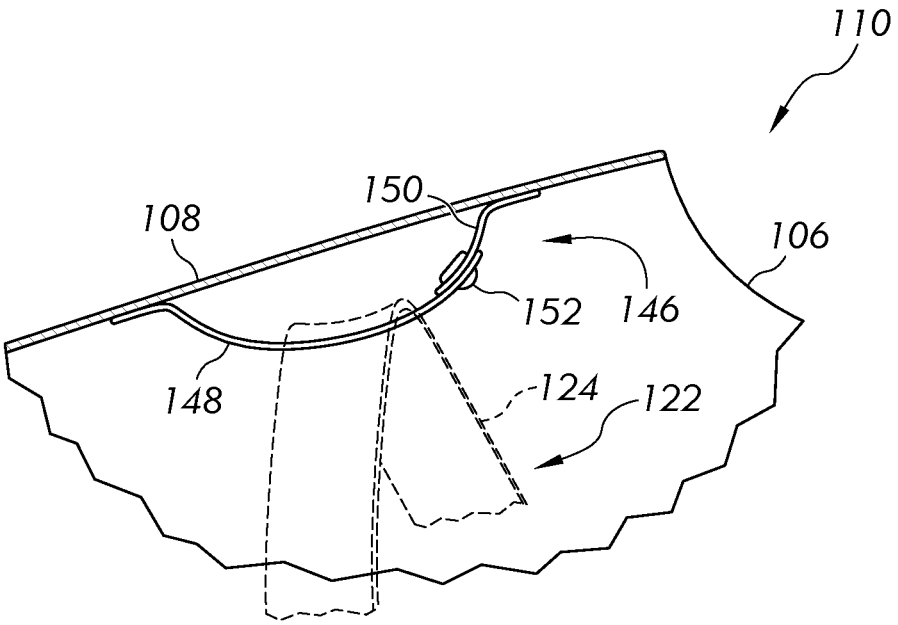
FIG. 3 schematically depicts a retention loop of the garment of FIG. 1, according to one or more embodiments shown and described herein.

In some embodiments, the retention loops 146 may be continuous members such that the shoulder straps 124 cannot be removed from the retention loops 146 and remain retained to the shoulders 108 of the outer body 100. Referring now to FIG. 3, in other embodiments, the retention loops 146 may include a first portion 148 and a second portion 150 that may be coupled together the close the retention loops 146 or released the open the retention loops 146. For example, the first portion 148 and the second portion 150 may be releasably coupled by a closure 152 such as a snap, button, hook and loop closure, and the like. Accordingly, when the closure 152 is closed such that the retention loops 146 are closed, the retention loops 146 may retain the shoulder straps 124 in place. Conversely, when the closure 152 is open such that the retention loops 146 are open, then the shoulder straps 124 may be detachable from shoulders 108 of the outer body 100.

Referring back to FIG. 1, in some embodiments, the garment 10 may not include retention loops 146. Instead, the shoulder straps 124 may be coupled directly to the shoulders 108 of the outer body 100. For example, the shoulder straps 124 may be sewn to the shoulders 108 of the outer body 100. Accordingly, the shoulder straps 124 may be non-removably retained in place.

Figure 4:
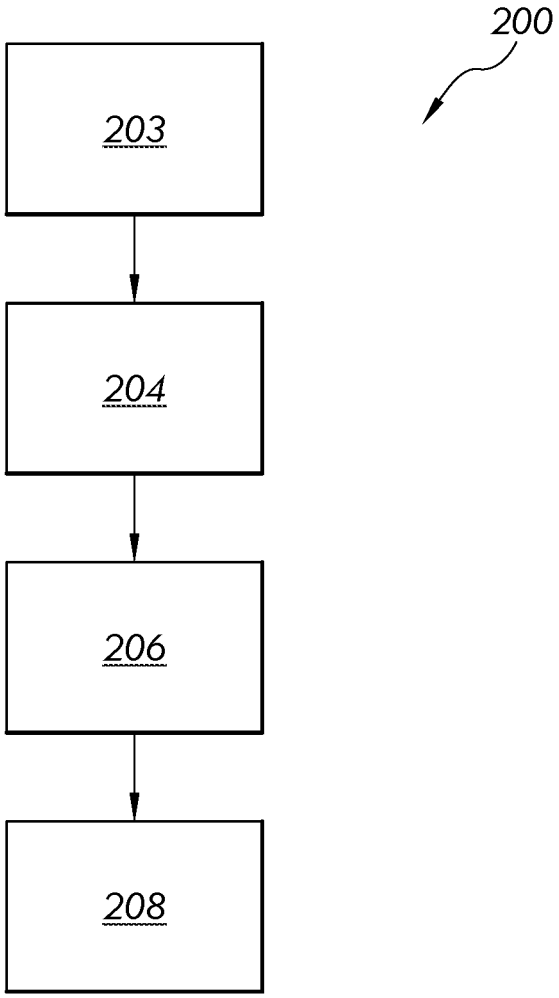
FIG. 4 schematically depicts a flow diagram of an illustrative method of assembling the garment of FIG. 1, according to one or more embodiments shown and described herein.

Referring now to FIG. 4. a method 200 of assembling the garment 10 may include a first step 202 wherein the outer body 100 is assembled and/or provided. The method 200 may include a second step 204 wherein the bra body 122 is assembled and/or provided. It is noted that the second step 202 may be completed prior to the first step 202 in some embodiments. After the first step 202 and the second step 204, the method 200 may include a third step 206 wherein the attachment members 140 are attached (e.g., sewn) to the outer body 100 and to the bra body 122, thereby coupling the outer body 100 to the bra body 122 such as described hereinabove. The method 200 may include a fourth step 208 wherein the retention loops 146 are attached (e.g., sewn) to the outer body 100. It is noted that, in embodiments wherein the retention loops 146 include a closure 152, the fourth step 208 may be completed at any time during the method 200. However, in embodiments wherein the retention loops 146 do not include a closure 152 and therefore do not open and close, the fourth step 208 should be completed after the first step 202 and the second step 204 such that the retention loops 146 may be attached (e.g., sewn) around the shoulder straps 124 of the bra body 122.

In view of the above, it should now be understood that at least some embodiments of the present disclosure are directed to a garment to be worn by a wearer. The garment includes an outer body that defines a garment shoulder and an underarm portion disposed below the garment shoulder of the garment. The garment includes a bra feature coupled to the underarm portion. The bra feature includes a bra body and a first attachment member. The bra body is configured to encircle a chest of the wearer. The first attachment member extends between a first end and a second end. The first attachment member is coupled to the bra body at the first end and to the underarm portion of the garment at the second end, thereby fixing the bra body to the underarm portion of the garment while permitting movement of the bra body relative to the underarm portion of the garment.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A garment, comprising:

an outer body defining a garment shoulder and an underarm portion disposed below the garment shoulder; and a bra feature comprising:

a bra body configured to encircle a chest of a wearer; and a first attachment member having a length and extending along the length from a first end coupled to the bra body to a second end coupled to the underarm portion of the garment, fixing the bra body to the underarm portion of the garment while permitting movement of the bra body relative to the underarm portion of the garment.

2. The garment of claim 1, wherein the bra feature further comprises a shoulder strap.

3. The garment of claim 2, wherein the shoulder strap comprises a slider movable to selectively adjust a length of the shoulder strap.

4. The garment of claim 2, wherein the shoulder strap has a thickness of greater than 0.5 inches.

5. The garment of claim 2, wherein the garment shoulder further comprises a retention loop fixed to the garment shoulder, the retention loop configured to retain the shoulder strap to the garment shoulder.

6. The garment of claim 5, wherein the retention loop comprises a closure configured to open and close the retention loop, wherein the shoulder strap is detachable from the garment shoulder when the retention loop is open.

7. The garment of claim 1, wherein:

the underarm portion of the outer body is a first underarm portion; and the bra feature further comprises a second attachment member having a length and extending along the length from a first end, coupled to the bra body opposite the first end of the first attachment member, to a second end coupled to a second underarm portion of the garment opposite the first underarm portion.

8. The garment of claim 1, wherein the length of the first attachment member is greater than 0.5 inches.

9. The garment of claim 1, wherein the bra feature further comprises cups coupled to the bra body and configured to support breasts of the wearer.

10. The garment of claim 9, wherein the cups are removably coupled to the bra body.

11. The garment of claim 1, wherein the bra feature further comprises an elastic band disposed along a bottom of the bra feature.

12. A garment to be worn by a wearer, comprising:

an outer body defining a garment shoulder and an underarm portion disposed below the garment shoulder; and a bra feature including:

a bra body configured to encircle a chest of the wearer;

a first attachment member having a length and extending along the length from a first end coupled to the bra body to a second end coupled to the underarm portion of the garment, fixing the bra body to the underarm portion of the garment while permitting movement of the bra body relative to the underarm portion of the garment; and a first shoulder strap extending from the bra body and configured to extend over a shoulder of the wearer, wherein the first shoulder strap is coupled to the garment shoulder.

13. The garment of claim 12, wherein the first shoulder strap is coupled directly to the garment shoulder.

14. The garment of claim 12, wherein the first shoulder strap is coupled to the garment shoulder via a retention loop extending from the garment shoulder.

15. The garment of claim 12, wherein the bra feature further includes a second shoulder strap, wherein the first shoulder strap and the second shoulder strap are arranged in a racerback configuration.

16. The garment of claim 12, wherein the first shoulder strap has an adjustable length.

17. A garment to be worn by a wearer comprising:

a shirt comprising a garment shoulder and an underarm portion disposed below the garment shoulder; and a bra feature including:

a bra body configured to encircle a chest of the wearer; and a first attachment member having a length and extending along the length from a first end coupled to the bra body to a second end coupled to the underarm portion of the shirt, fixing the bra body to the underarm portion of the shirt while permitting movement of the bra body relative to the underarm portion of the shirt.

18. The shirt of claim 17, wherein the length of the first attachment member is greater than 1.5 inches.

19. The shirt of claim 17, wherein the bra feature further comprises a shoulder strap.

20. The shirt of claim 19, wherein the shoulder strap comprises a slider configured to selectively adjust a length of the shoulder strap.

* * * * *